United States Patent [19]

Yeh

[11] 4,066,526

[45] Jan. 3, 1978

[54] METHOD AND APPARATUS FOR ELECTROSTATIC SEPARATING DISPERSED MATTER FROM A FLUID MEDIUM

[76] Inventor: George Chiayou Yeh, Smedley Drive, R.D. 1, Newtown Square, Pa. 19073

[21] Appl. No.: 498,423

[22] Filed: Aug. 19, 1974

[51] Int. Cl.[2] ..... B03C 5/00

[52] U.S. Cl. ..... 204/186; 55/2; 55/127; 55/131; 55/152; 204/302

[58] Field of Search ..... 204/186–191, 204/302; 55/2, 127, 131, 138, 146, 150–157

[56] References Cited

U.S. PATENT DOCUMENTS

| | | | |
|---|---|---|---|
| 1,427,370 | 9/1922 | Fortescue | 55/138 |
| 2,116,509 | 5/1938 | Cottrell | 204/188 |
| 3,074,870 | 1/1963 | Carswell et al. | 204/188 |
| 3,154,682 | 10/1964 | Hartz et al. | 55/2 |
| 3,496,701 | 2/1970 | Berg | 204/186 |
| 3,544,441 | 12/1970 | Griswold | 204/186 |
| 3,733,784 | 5/1973 | Anderson et al. | 55/138 |
| 3,790,461 | 2/1974 | Yeh | 204/180 |

FOREIGN PATENT DOCUMENTS

| | | | |
|---|---|---|---|
| 581,530 | 9/1924 | France | 55/131 |

*Primary Examiner*—Bernard Nozick
*Attorney, Agent, or Firm*—James Albert Drobile

[57] ABSTRACT

Herein are disclosed a method and apparatus whereby dispersed matter in the form of finely-divided particles, and/or in the form of molecular species such as molecules, and atoms are separated from a gaseous or liquid medium by subjecting same by a corona discharge via a perforated separating electrode to repel same and continuously removing the charged matter.

8 Claims, 3 Drawing Figures

METHOD AND APPARATUS FOR ELECTROSTATIC SEPARATING DISPERSED MATTER FROM A FLUID MEDIUM

BACKGROUND OF THE INVENTION

1. Field of the Invention

This invention relates to the separation of dispersed matter from a liquid or gaseous medium through the use of an electrostatic force. More particularly, the invention is directed to a new and improved method and apparatus for separating dispersed matter, consisting of finely-divided particles and/or any ionizable chemical species such as molecules, atoms and radicals (such species being hereinafter referred to as "molecular species"), from a fluid medium by means of an electrostatic repulsive force.

2. Description of the Prior Art

In the conventional electrostatic precipitation of particulate matter from a fluid medium, it is well understood that separation of the particulate matter in the fluid is achieved through the following three basic steps: (a) electrostatic charging of particulate matter with a discharging electrode, (b) collecting of the charged particulate matter with a grounded electrode, and (c) removal of the collected particulate matter from the grounded electrode. Since the ultimate separation of the particulate matter from the fluid is accomplished only when the collected particulate matter is removed from the collecting electrode and placed outside the electrostatic precipitator, the insufficient retention of the particulate matter in the applied field, and the re-entrainment into the fluid stream of particulate matter which already had been collected, would result in poor separation efficiencies.

The above two difficulties are minimized by the use of low fluid velocities, and by the continuous removal of the collected particulate matter from the collecting electrode. As a result of these limitations, however, the size, the complexity and the cost of an efficient electrostatic precipitator typcially are very great.

The so-called "electrostatic filter", such as one disclosed in U.S. Pat. No. 3,544,441, issued to E. A. Griswold on Dec. 1, 1970, may increase the degree of particle retention in the electrostatic field, and so reduce substantially the particle re-entrainment into the fluid. But, periodic removal of the collected material is required, as is frequent cleaning of the porous matrix which is used. Furthermore, due to the high concentration and long retention of the charged particles in the field near the collecting electrode, abnormal particle charging and resultant undesirable separation characteristics in the apparatus would be inevitable. These phenomena might include back corona discharge, the lowering of the spark-over voltage, the suppression of particle charging, and the like.

It is most important to note that, in every conventional electrostatic separation technique, the particulate matter is charged by the discharging electrode, and attracted to the collecting electrode by which the particles are separated from the fluid. In other words, the collecting electrode is acting as the separating electrode. It thus is the electrostatic attractive force between the charged particulate matter of one polarity and the collecting electrode of the other polarity that constitutes the driving force for the separation in accordance with conventional techniques. The electrostatic repulsive force is not utilized in any separation technique heretofore known. Therefore, molecular species other than those adsorbed on the collected particulate matter cannot be separated from the fluid medium, since the ionized molecular species would be neutralized on the collecting electrode and remain free within the fluid medium.

SUMMARY OF THE INVENTION

This invention is directed to a method and apparatus for separating dispersed matter, specifically finely-divided particles and/or molecular species (hereinafter, "molecular species" is intended to mean and include any ionizable chemical species such as molecules, atoms and radicals), from a gaseous or liquid medium, by the use of an electrostatic repulsive force, rather than through the use of the electrostatic attractive force which is utilized in all conventional electrostatic separation techniques and apparatus.

The present invention is directed particularly to a method and apparatus for separating or fractionating dispersed matter, consisting of particles and/or molecular species, from a fluid medium. The method of the present invention comprises electrostatically charging said particles and/or ionizing said molecular species (if such, respectively, are not already charged and/or ionized), and then passing the fluid medium and dispersed matter through a suitably constructed, filter-like electrode (hereinafter, the "separating electrode") which is pervious to the passage of fluid medium and such dispersed matter, and which is generating a corona discharge of the same polarity as that of the charged particles and/or the ionized molecular species. In a typical embodiment of the apparatus of the present invention, the separating electrode is constructed in the form of a filter utilizing a fine wire mesh (or coil, cloth, felt, thin packed layer or the like), or a porous metal plate having pointed exterior surfaces, and is capable of being electrostatically charged and of providing a corona discharge, in response to such charging, from its exterior surfaces which are in contact with the oncoming stream of fluid medium and dispersed matter.

The separation achieved by the method and apparatus of the present invention is effected by the strong repulsive force which exists between the aforementioned corona discharge, on the one hand, and the charged particles and/or ionized molecular species of the same polarity, on the other hand, when the fluid medium containing dispersed matter is subjected to the field of the corona discharge in being forced to flow through the separating electrode. The separating electrode theoretically allows only the uncharged fluid medium to pass through, and rejects all of the charged particles and ionized molecular species of the same polarity as the electrode. As a result of this repulsion and selective rejection, the separation of said charged particles and/or said ionized molecular species from the fluid medium is accomplished.

In the separation method and apparatus provided by the present invention, the complete and ultimate separation of the charged particles and/or the ionized molecular species occurs at the discharging electrode (according to the present invention, synonomous with the so-called separating electrode) due to the electrostatic repulsive force. Such separation is not due to any electrostatic attraction force. For this reason, ionized molecular species as well as charged particles can be separated by practice of the present invention in contrast to prior techniques. It thus is essential to keep in mind that separation is effected by the discharging electrode (i.e., the separating electrode), and not by the collecting electrode, and that the driving force for such separation is the electrostatic repulsive force and not the electrostatic attractive force.

In the "electrical double-layering" technique for liquid separation developed by the present inventor and disclosed in U.S. Pat. No. 3,790,461, issued Feb. 5, 1974, the single electrode therein required also constitutes the separating electrode. However, the driving force for forming the electrical double-layer utilized in the separation of charged particles and/or polarizable molecules is the electrostatic attractive force, and not the electrostatic repulsive force. For this reason, the removal of the collected material from that electrode is required as in all other heretofore-known electrostatic separation methods.

The electrostatic repulsion between two charged bodies of identical polarity is a well-known phenomenon. However, it has never been demonstrated that this electrostatic repulsive force could be utilized to separate charged particles and/or ionized molecular species from a fluid medium in which they were originally contained. This repulsive force can be so utilized if the discharging electrode is constructed and configured so as to be adapted to generate a dense and uniformly-distributed corona discharge from its exterior surfaces, in which case it then also can function as the separating electrode in accordance with the present invention.

This inventor has determined experimentally that a discharging electrode, constructed in the form of a fine wire mesh or cloth, or of a porous metal plate having many pointed surfaces, can generate a screen of dense and uniformly-distributed corona discharge which can not only charge dispersed particles and/or ionize molecular species, but can also selectively reject and filter out the charged particles and ionized molecular species of the same polarity. For example, a 400-mesh stainless steel cloth, which is made of fine wire having a diameter of 10 mils (0.010 inches), and which has an average opening of 15 mils (0.015 inches), can be used as a discharging (and separating) electrode to generate a corona discharge of a current density of a few milliamperes per square inch of its surface area. This corona discharge can effectively charge graphite powder (ninety percent (90%) of which will pass through the same 400-mesh stainless steel cloth), and can completely prevent the penetration of the graphite powder through the cloth when the graphite powder is dispersed in an air stream moving through the 400-mesh stainless steel cloth at a velocity as high as 110 feet per second.

Further experimental studies of a similar nature were made using various types of particulate matter, various separating electrode configurations and construction materials, and varying electrical loads. The same or a substantially similar phenomenon was observed each time. From these exploratory studies, the present inventor has determined that the electrostatic repulsive force acting on a particle of very small size (i.e., of a few microns or less in diameter), and on ionized molecular species, is many thousands of times greater than the inertial and viscous forces of the fluid medium acting on the same particle or molecular species in a given system, provided a well-constructed discharging (separating) electrode and a sufficient electrical load are utilized. Under these conditions, the electrostatic repulsive force of the corona discharge acting on a charged particle or ionized molecular species in a short range is far greater than the electrostatic attractive force existing between the charged particle (or ionized molecules) and the collecting electrode in a far longer range, as is usually the case in the conventional electrostatic precipitator. This inventor has concluded that the above facts enable charged particles and/or ionized molecular species to be rapidly and completely separated from a fluid medium in accordance with the present invention.

Because of the novel separation principle of the present invention, the method and apparatus provided by this invention should be capable of separating and fractionating virtually all types and sizes of particles, and all molecular species which can be ionized, from a fluid medium in which they are originally contained, even under operational conditions that would preclude their separation by conventional electrostatic separation techniques. The present invention permits of a complete, rapid, economical and truly continuous separation of particles and/or ionizable molecular species from a fluid medium. A few illustrative applications of this invention are: indoor and outdoor air quality control; separation or fractionation of mixed particulate matter and/or ionizable molecules; purification of air and other gases; removal of particulate matter from a high velocity fluid stream at high temperatures and pressures with negligible pressure drop; and the like.

A particular advantage of the method and apparatus of the present invention is that, since separation is accomplished by repulsion forces rather than attraction forces, the separating electrode does not tend to become fouled by the material being separated.

It is a primary object of the present invention to provide a simple method and apparatus for electrostatically and continuously separating or fractionating chargeable particles and/or ionizable molecular species from a fluid medium in which they are contained, with a greater separation efficiency, and at a lower cost and space requirement, than heretofore has been attainable through the use of known techniques.

It is another object of this invention to provide a simple method and apparatus for electrostatically and continuously separating or fractionating chargeable particles and/or ionizable molecular species under the operational conditions which make separation by conventional electrostatic separation techniques impracticable or extremely difficult.

It is still another object of this invention to provide a simple method and apparatus for effecting mass transfer, and/or mass transfer accompanied by chemical reaction, between fluid molecules and particulate matter (either solid or liquid), and the subsequent separation of the mixture of reactants and products after the contacting between the two. In this case, the apparatus provided by this invention is not only a contacter or reactor, but also a separator at the same time.

It should be understood that the finely-divided particulate matter which can be separated from a fluid medium through practice of the present invention includes microorganisms such as bacteria, viruses and the like. Accordingly, a further object of this invention is to provide a simple method and apparatus for effecting a rapid and substantially complete separation of microorganisms and the like from a fluid medium in which they are dispersed, i.e., a disinfection of said fluid medium, in an economical and truly continuous manner.

BRIEF DESCRIPTION OF THE DRAWINGS

The accompanying drawings illustrate the method and several embodiments of the apparatus of the present invention.

FIG. 1 also serves to illustrate, schematically and in a very fundamental way, the basic steps comprising the method of the invention.

DETAILED DESCRIPTION OF THE INVENTION (INCLUDING DESCRIPTION OF PREFERRED EMBODIMENTS)

The invention now will be described in detail, by reference to the several specific embodiments shown in the accompanying drawings.

Figure 1:
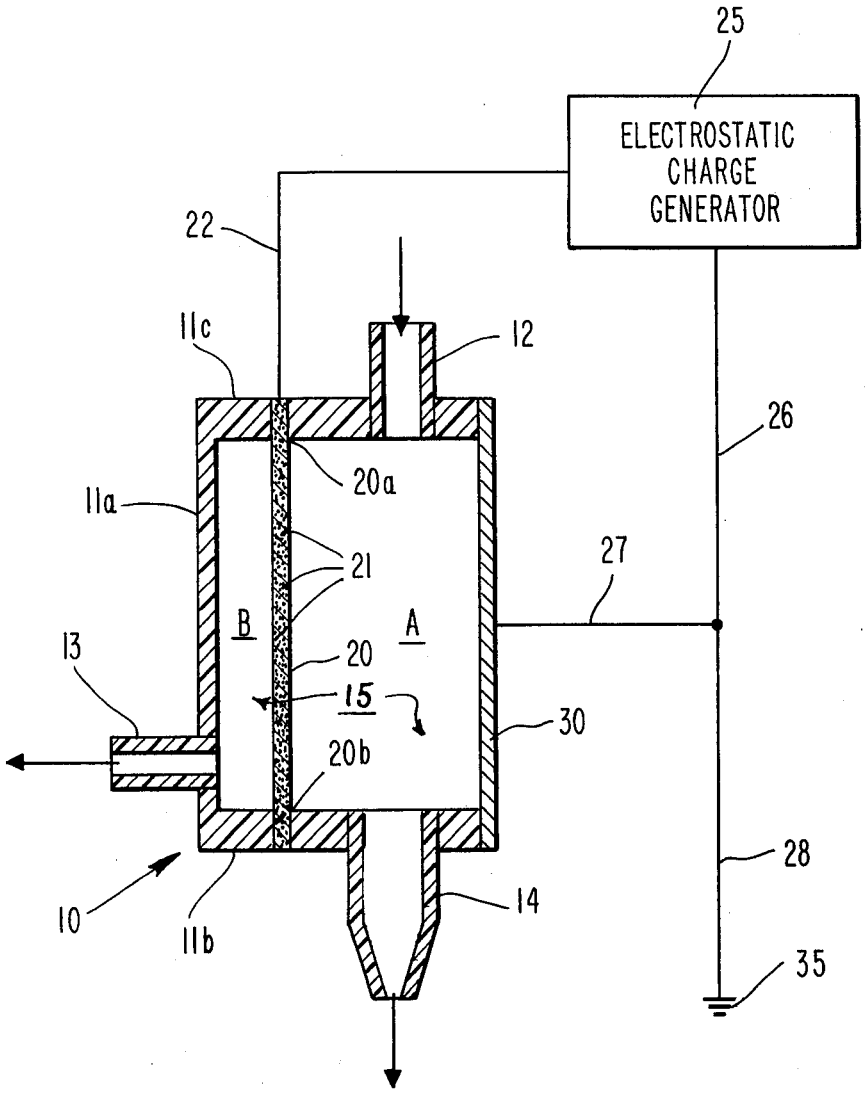
FIG. 1 is a partial section of a simplified, experimental apparatus according to the invention, using a single-plane separating electrode for separation.

As noted, FIG. 1 illustrates the practice of the method of the present invention, through the use of one embodiment of the separation apparatus of the invention. As shown in FIG. 1, the separation apparatus consists of a rigid enclosure 10 defining a chamber 15 adapted for containing a fluid. As also indicated in FIG. 1, portions 11*a*, 11*b* and 11*c* of enclosure 10 are constructed from a dielectric material, i.e., an electrical insulation material, while portion 30 of enclosure 10 is constructed from a material which is electrically conductive. Portion 30 of enclosure 10 constitutes an electrode, viz., the "collecting electrode" in accordance with the invention. The use of a collecting electrode 30 in the method and apparatus of the present invention is preferable but not essential, and enclosure 10 may be constructed exclusively from dielectric material.

Enclosure 10 may be of any desired size and shape, and may be constructed of any suitable material. In one specific embodiment, utilized as an experimental apparatus, the enclosure 10 was fabricated entirely from PLEXIGLASS methyl acrylate plastic, except for collecting electrode 30 which was fabricated from steel plate. The size of enclosure 10 in that experimental apparatus was 8 inches by 8 inches by 10 inches high.

Enclosure 10 contains a separating electrode 20, which separates chamber 15 into zones A and B, and which contains apertures 21 rendering it pervious to the passage of fluid medium and dispersed matter. Separating electrode 20 also is adapted in its construction and configuration to produce a suitable corona discharge in response to being electrostatically charged to a sufficient degree. (Separating electrode 20 also serves as the discharging electrode in those instances where the dispersed matter has not been charged and/or ionized prior to being subjected to the field of the corona discharge.) Separating electrode 20 is electrically insulated from enclosure 10, by virtue of the fact that ends 20*a* and 20*b* of separating electrode 20 are embedded in non-conductive portions 11*c* and 11*b*, respectively, of enclosure 10.

As noted above, separating electrode 20 is pervious to the passage of fluid medium and dispersed matter, and must be fabricated so as to satisfy that requirement. Any materialof construction which is conductive to electricity, and which will permit of the passage of fluid medium and dispersed matter, is suitable for use in the practice of the present invention. Porous metals and wire screening are particularly useful. In the experimental apparatus to which reference already has been made, the separating electrode 20 is constructed of four superimposed layers, each layer being 12 inches by 8 inches, and fabricated from a 400-mesh stainless steel cloth. When molecular species rather than dispersed particles were being separated in this experimental apparatus, the separating electrode 20 consisted of a 12-inch by 8-inch piece of porous sintered stainless steel having a porosity of 60 volume percent and an average pore size of 20 microns.

Separating electrode 20 is connected by electrical conductor means 22, to an external generator of electrostatic charge 25, such as a high-voltage power supply. Separating electrode 20 is connected to a terminal of the generator 25 (e.g., high-voltage power supply) having the desired polarity, and the other terminal (having the opposite polarity) is connected to electrical ground 35 through electrical conductor means 26 and 28, as shown. Collecting electrode 30 is shown as connected through electrical conductor means 27 and 28 to electrical ground 35. The generator of electrostatic charge 25 employed with this apparatus embodiment was a high-voltage power supply capable of reversing the polarity and of generating voltages in the range between 0 and plus or minus 60 K.V. (kilovolts).

Enclosure 10 includes access means 12 for introducing fluid medium containing dispersed matter into zone A of chamber 15, and access means 13 for withdrawing, from zone B of chamber 15, a fluid medium containing the reduced concentration of dispersed matter. Enclosure 10 also includes accessmeans 14 for withdrawing, from zone A of chamber 15, dispersed matter in a relatively concentrated form.

In accordance with the method of the invention, as practiced with the apparatus illustrated in FIG. 1, a fluid medium containing dispersed matter consisting of finely-divided particles and/or molecular species is introduced to zone A of chamber 15 through access means 12. The dispersed particulate matter is not electrostatically charged, and the molecular species are not ionized, prior to their introduction to zone A of chamber 15. Said particles are electrostatically charged, and said molecular species are ionized, by being subjected to the field of the corona discharge provided by discharging and separating electrode 20. Upon becoming so charged and ionized, the dispersed matter is selectively repulsed by the corona discharge of separating electrode 20, and is collected adjacent grounded collecting electrode 30 and continuously removed from zone A of chamber 15 through access means 14. A fluid medium containing a substantially reduced concentration of dispersed matter is passed through apertures 21 of separating electrode 20 and into zone B of chamber 15, and is continuously withdrawn from zone B through access means 13.

For the separation of molecular species in particular, the fluid medium which is transporting the dispersed matter including molecular species is split between the two exit streams in a fixed ratio, and is withdrawn continuously from access means 13 and 14 in that ratio. This technique prevents or minimizes possible abnormal ionization in the apparatus.

For the separation primarily of finely-divided particles, the discharging and separating electrode 20 is connected to either the negative or the positive terminal of the electrostatic charge generating source 25, although a discharge of negative polarity has been found to be the more effective in most instances and is, therefore, preferred. For the separation of molecular species, the polarity of the corona discharge is determined by the electron affinity and/or the ionization potential of the particular molecular species to be ionized and separated. In general, a corona discharge of negative polarity is employed with electronegative molecular species, and a corona discharge of positive polarity is employed with electropositive molecular species including positive ions.

Figure 2:
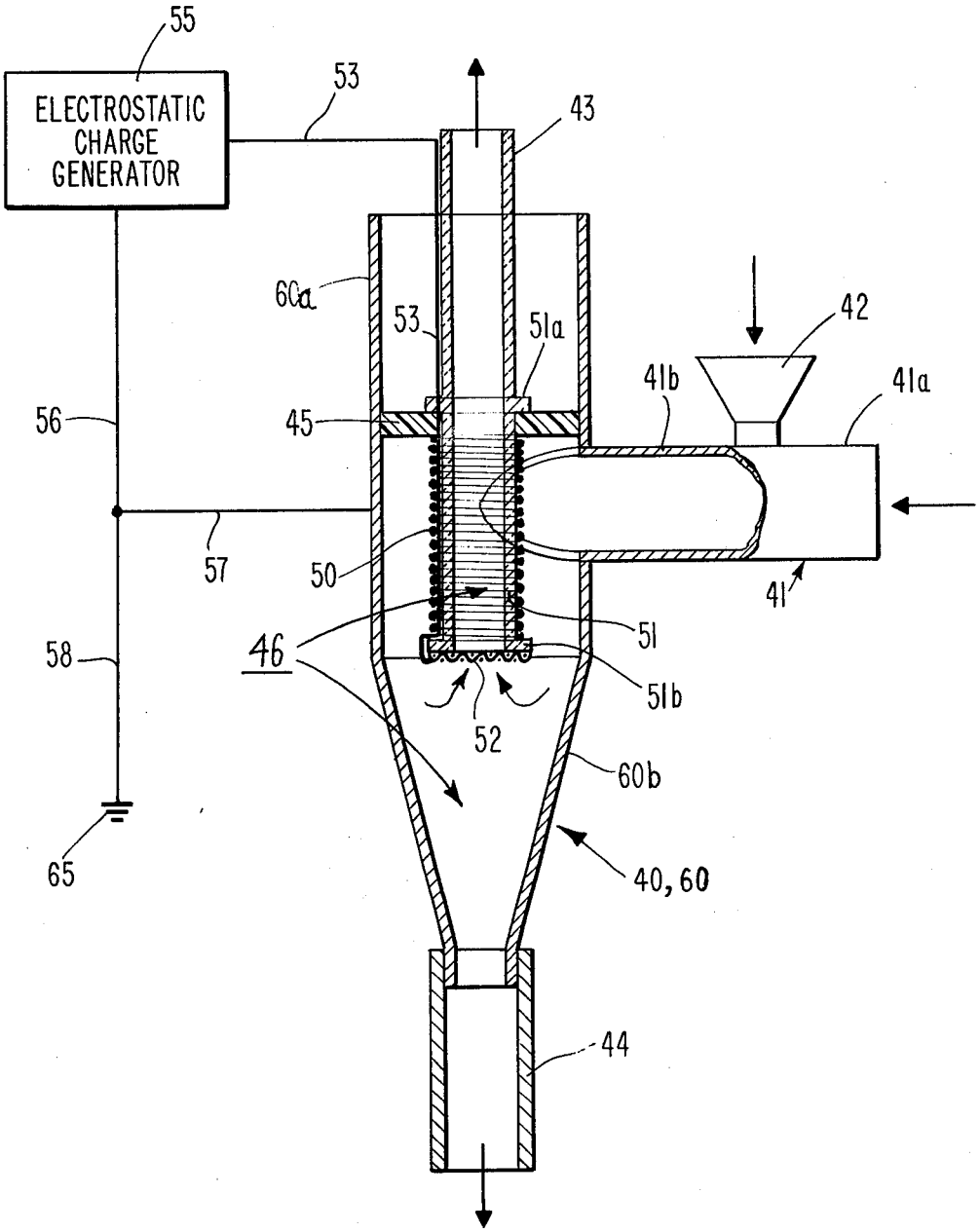
FIG. 2 is a partial vertical section of another experimentally-tested apparatus according to the invention, using a single cylindrical separating electrode inside a cyclone-shaped collecting electrode.

FIG. 2 illustrates the practice of the present invention in another apparatus embodiment, and specifically in another actual experimental apparatus. In FIG. 2, enclosure 40 also constitutes the grounded collecting electrode 60. As indicated, enclosure 40 (collecting electrode 60) is fabricated entirely of an electrically-conductive material, and consists of a cylindrical upper portion 60*a* and a conical bottom portion 60*b*. Enclosure 40 (collecting electrode 60) is connected to ground 65 through electrical conductor means 57 and 58. Enclosure 40 defines internal chamber 46, which is adapted to contain a fluid. In the specific experimental apparatus to which reference is made above, the enclosure 40 is fabricated from sheet steel, and has an upper cylindrical portion 60*a* which is 12 inches in diameter, a lower cylindrical portion which reduces to a diameter of 3 inches, and an overall vertical height of 3 feet from the bottom of the conical portion to the top of chamber 46 (at sealing ring 45 in FIG. 2).

As also shown in FIG. 2, the separating electrode (which also may serve as a discharging electrode when the dispersed matter as introduced is not electrostatically charged and/or ionized) consists of a combination of a coil 50 of electrically-conductive material, and a fine-mesh screen 52 of electrically-conductive material, both of which are mounted upon a hollow spool 51, having flanges 51*a* and 51*b*, and which is fabricated from a suitable dielectric material. Spool 51, containing the separating and discharging electrode consisting of coil 50 and screen 52, is mounted internally of enclosure 40 and within chamber 46 by any suitable structural means such as annular sealing ring 45 which supports the spool 51 at flange 51*a*, and which seals the space between spool 51 and the cylindrical portion 60*a* of enclosure 40 (collecting electrode 60). Annular sealing ring 45 is fabricated from a dielectric material, so as to insulate the elements 50 and 52 of the discharging and separating electrode from the collecting electrode 60. The separating and discharging electrode consisting of elements 50 and 52 is connected by electrical conductor means 53 to external electrostatic charge generator 55, the latter device being connected through electrical conductor means 56 and 58 to ground 65.

In the specific experimental apparatus typifying the apparatus of FIG. 2, the coil 50 was made of 24-gauge stainless steel wire wrapped around the exterior cylindrical surface of spool 51, which consisted of a 10-inch long (as measured between flanges 51*a* and 51*b*) piece of hollow glass pipe having an outside diameter of 3 inches, and both ends of which were flanged. The uppermost flange 51*a* of glass spool 51 was sealed to an annular sealing ring 45, which was constructed of fibreglass in order to insulate the separating and discharging electrode electrically from the collecting electrode 60. The bottom opening of spool 51, as defined by lower flange 51*b*, is covered by a 400-mesh stainless steel cloth. The glass spool 51 remains open at the top, to define access means 43 through which the fluid medium containing a reduced concentration of dispersed matter is withdrawn. The stainless steel screen 52 and the stainless steel coil 50 together function as the separating and discharging electrode. The electrostatic charge generator 55 utilized in the experimental apparatus typifying the apparatus of FIG. 2 was identical with that used in the experimental apparatus illustrated in FIG. 1.

In the apparatus of FIG. 2, access means 41 are provided in enclosure 40 for the introduction of fluid medium containing dispersed matter to chamber 46. As shown in FIG. 2, access means 41 enter enclosure 40 tangentially, so as to impart a swirling motion to the entering stream for the purpose of improving the efficiency of separation. Access means 41 also permit of the separate introduction of fluid medium at 41*a*, and of dispersed matter at 42, prior to their being mixed in portion 41*b* and introduced to chamber 46 of enclosure 40. On the other hand, a fluid medium which already contains dispersed matter can be introduced into access means 41 at 41*a*, and will proceed through portion 41*b* of access means 41 into chamber 46 of enclosure 40. Enclosure 40 also is equipped with access means 44, for withdrawing dispersed matter.

In operation, the apparatus illustrated in FIG. 2 is in all material respects identical to the method of operation of the apparatus illustrated in FIG. 1.

Figure 3:
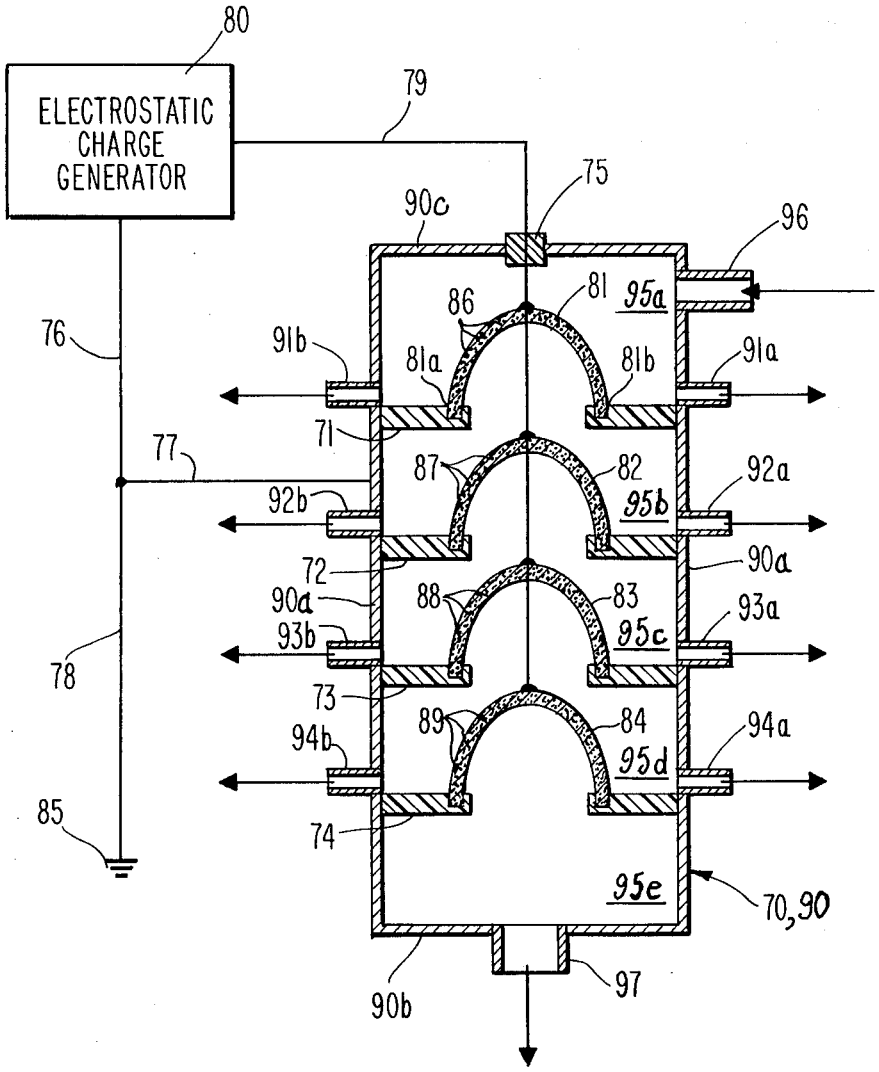
FIG. 3 is a partial vertical section of another apparatus embodiment of this invention, using several separating electrodes in series for the purpose of fractionating a mixture of particulate matters and/or molecular species.

FIG. 3 illustrates yet another apparatus embodiment which is useful in the practice of the method of the present invention. In FIG. 3, the separation apparatus comprises vertical enclosure 70, defining an internal chamber 95 which is adapted to contain a fluid. Enclosure 70 consists of cylindrical side portion 90*a*, bottom portion 90*b* and top portion 90*c*, each of which is constructed from an electrically conductive material. Accordingly, enclosure 70 functions also as the collecting electrode 90, which is connected to ground 85 through electrical conductor means 77 and 78. Chamber 95, defined by enclosure 70, is divided into subchambers 95*a*, 95*b*, 95*c*, 95*d*, and 95*e*, by separating and discharging electrodes 81, 82, 83 and 84, which are sealed in enclosure 70, vertically, one under the other, by means of transverse annular sealing rings 71, 72, 73 and 74, respectively. Each of said sealing rings is connected, near its inner opening, to the base of the corresponding separating electrode, as at the loci designated 81*a* and 81*b* with respect to separating electrode 81. The annular sealing rings 71, 72, 73 and 74 are fabricated from a dielectric material, so as to insulate electrically the separating electrodes 81, 82, 83 and 84 from the collecting electrode 90. Each of the separating electrodes 81, 82, 83 and 84 are so constructed, in configuration and material, so as to be pervious to the passage of fluid medium and dispersed matter, and so as to be adapted, upon the imposition of an electrostatic charge of sufficient magnitude and suitable polarity, to produce a corona discharge in polarity identical to that of the charged particles and/or ionized molecular species to be separated. The apertures providing for the passage of dispersed matter and fluid medium through separating electrodes 81, 82, 83 and 84 are indicated, respectively, at 86, 87, 88 and 89. These separating electrodes 81, 82, 83 and 84 are connected by electrical conductor means 79 through dielectric block 75 to external electrostatic charge generating source 80, which in turn is connected through electrical conductor means 76 and 78 to electrical ground 85, in the same manner as in the apparatus illustrated in FIGS. 1 and 2.

Enclosure 70 includes access means 96 for introduction of fluid medium containing dispersed matter, and access means 97 for withdrawal of fluid medium containing a reduced concentration of such dispersed matter. Each of subchambers 95*a*, 95*b*, 95*c*, and 95*d*, contain access means, 91*a* and 91*b*, 92*a* and 92*b*, 93*a* and 93*b*, and 94*a* and 94*b*, respectively, for withdrawing separated dispersed matter in concentrated form.

In all material respects, the method to be practiced in the operation of the apparatus illustrated in FIG. 3 is generally identical to that practiced in connection with the apparatus of FIG. 1. Thus, a fluid medium containing dispersed matter is introduced into subchamber 95*a* of enclosure 70 through access means 96. The dispersed matter is charged and/or ionized, if necessary, and is selectively repelled by the field of the corona discharge occurring first at separating electrode 81. Separated dispersed matter is collected near the adjoining portions 90*a* and 90*c* of collecting electrode 90 formed by enclosure 70, and is withdrawn in relatively concentrated form through access means 91*a* and 91*b*. A fluid medium containing a reduced concentration of dispersed matter is passed through the apertures 86 of separating electrode 81 and into subchamber 95*b*, where the same phenomenon is repeated. Ultimately, a fluid medium substantially free of dispersed matter, or having a substantially reduced concentration thereof, is withdrawn from enclosure 70 through access means 97.

Thus, it will be seen that the dispersed matter contained in the fluid medium entering the apparatus shown in FIG. 3 is fractionated in a stage-wise separation, each of such stages representing a separator embodying the principles of the present invention. This fractionation is brought about through the use of a series of discharging electrodes, and through utilization of the differing physical and electrical properties of the materials to be separated, all of which cause different separation characteristics to obtain at each stage. In an exactly similar manner, fractionation of a mixture of various molecular species also can be accomplished.

The apparatus illustrated in FIG. 3 also may be used to treat several feed streams at the same time, simply by providing access means for the introduction of each of such streams.

It should be emphasized that the grounded collecting electrode is not essential to the practice of the present invention, since it is the separating electrode that separates the charged particles and/or ionized molecular species. However, the use of a collecting electrode is distinctly preferred, since it facilitates the collection and continuous removal of the repelled charged particles and/or ionized molecular species, and thus prevents or reduces abnormal charging or ionization which would lower the separation efficiency. Furthermore, by grounding the apparatus through the collecting electrode the safety of the operator may be secured, especially if the apparatus is not a perfect Faraday cage. However, it is not essential to the successful practice of this invention that a collecting electrode, where employed, be grounded.

The results of extensive study and developmental work have shown that substantially complete separation of charged particulate matter and ionized molecular species is not only practical but economical through the practice of the present invention. Furthermore, the results of such work showed that the following separation characteristics of this invention obtained with respect to all particulate matter and molecular species studied:

1. The material of construction and the design of the separating electrode have a very strong influence on the characteristics of the corona discharge which is produced and, hence, on the separation efficiency. In general, the stronger and more dense is the corona discharge formed, the higher is the separation efficiency obtained.

2. In every case, the separation efficiency was found to increase with an increase in the electrical load, resulting in a stronger and more dense corona discharge being formed.

3. The wave form of the voltage applied, such as D-C, full-wave A-C, half-wave A-C, and the like, has little, if any, effect on the separation efficiency. However, it was found that very short voltage pulses (e.g., of a few micro-seconds or less) seemed to produce a more stable corona discharge, without spark-over between the two electrodes, and such practice is to be preferred.

4. The potential gradient existing between the two electrodes (where a collecting electrode is utilized) has an important effect upon the separation efficiency, i.e., the greater the potential gradient the higher the separation efficiency.

5. A corona discharge of negative polarity appears to give higher separation efficiencies in the separation of charged particles than does a corona discharge of positive polarity.

6. In the separation of molecular species having a relatively low ionization potential (i.e., a relatively great electron affinity), a corona discharge of negative polarity is more effective and is preferred. However, for molecular species having little or no electron affinity, a positive corona discharge can be as effective as a negative corona discharge.

7. For a particular electrical load, smaller particles are easier to separate than larger particles. This is because the larger particles have a greater tendency to clog the discharging electrode when an insufficient electrical load is employed.

8. The ratio in which the fluid medium is split between the two effluent streams, when molecular species are separated, has a decisive effect on the separation efficiency. The smaller the ratio of the stream of fluid medium carrying the reduced concentration of dispersed matter, to the stream of fluid medium carrying the increased concentration of dispersed matter, the greater the separation efficiency. For particle separation, the faster the rejected particles are removed from the apparatus, the greater is the separation efficiency obtained. The effect seems to be identical for the separation of molecular species, and suggests that the high concentration of the charged particles or ionized molecular species in the apparatus can cause abnormal charging or ionization, thus lowering the separation efficiency.

9. In particle separation, the more conductive is the particle, the higher is the separation efficiency, and also the lower is the required electrical load for a given separation efficiency.

10. The smaller is the applied electrical load, the greater is the required residence time for the particles and/or molecular species. Also, the greater the concentration of the particles and/or molecular species, the greater is the required electrical load which must be applied.

11. The flow conditions inside the apparatus can affect the efficiency with which the rejected material is collected and withdrawn.

12. The particles to be separated tend to clog the separating electrode when the applied electrical load is insufficient.

To summarize, the present invention has the following several unique and desirable features, namely: (1) it provides substantially complete and economical separation of particulate matter and ionizable molecular species from a liquid or gaseous medium; (2) it permits of truly continuous operation; (3) the apparatus and operation are extremely simple; (4) the apparatus is compact and portable; and (5) the method is flexible and applicable to a wide range of operating conditions. There are other benefits and advantages which will be apparent to those skilled in the art. Because of these unique and desirable features, this invention is useful in the purification, recovery, removal, sampling, analysis, separation, fractionation, concentration, dilution and the like, of all sorts of particulate matter (solid or liquid), and of any molecular species which are ionizable.

In accordance with the practice of the present invention, there are a number of alternative and desirable ways by which particulate matter and/or molecular species can be readily separated from a fluid medium in which they are contained originally. Examples are: (1) the fluid medium containing the dispersed matter can be brought into contact with, and then allowed to flow through, a separating electrode provided by this invention, but without using a collecting electrode; (2) a collecting electrode may be used in conjunction with the separating electrode; (3) for fractionation purposes; a mixture of the different types of materials to be fractionated may be dispersed into a fluid medium first, and then fractionated as described herein (in this way, particle size and/or mass spectra of dispersed matter can be determined); (4) the separating electrode may be moved through a stionary body of fluid medium containing the dispersed matter to be separated, said matter being selectively repulsed and moved by the moving electrode from one end of the fluid bulk toward the other end; (5) the cyclone effect may be utilized to facilitate the removal of the collected matter from the collecting electrode; (6) a moving collecting electrode may be used to facilitate the withdrawal of the collected matter by designing the collecting electrode in the form of a rotating drum, belt, or the like; (7) a pair of separating electrodes, as contemplated by this invention, may be used in the same apparatus to generate separately both negative and positive corona discharges for simultaneous separation from the fluid of both electronegative and electropositive molecules or positive ions and radicals, as may be obvious; (8) several separating electrodes may be placed in the same apparatus, as shown in FIG. 3, for the fractionation of a mixture of various types of dispersed matter; (9) the dispersed matter to be separated from a fluid medium can be charged or ionized using a conventional discharging electrode prior to contact with the separating electrode provided by this invention; (10) for a process in which it is desired to contact a solid with a liquid or gaseous fluid, or a liquid with a gaseous fluid, such as, for example, for the purpose of mass transfer or chemical reaction, the solid or liquid can be transformed into particulate form, introduced in that form into the apparatus with said fluid as the continuous phase, and readily separated in the same apparatus after the contacting operation. Absorption or adsorption processes carried out in apparatus constructed and operated in accordance with the present invention can be greatly enhanced by virtue of the greater ease of separation of the particulate matter.

In order to illustrate specifically the practice and the benefits of the present invention, the experimental apparatus referred to and described in detail in connection with FIGS. 1 and 2 of this application were utilized in a number of experimental separation runs conducted in accordance with the invention. The results of some typical runs are given in Tables I and II, the former reporting the results of runs involving the separation of particulate matter and the latter containing the results of runs involving the separation of molecular species. The apparatus used for each run is indicated by reference to the figure in which it is illustrated, and in connection with which it is described in detail.

In each of the runs reported in Table I, at least ninety percent (90%) by weight of the dispersed particulate matter would pass through a standard 400-mesh Tyler screen. For the runs in Table II, involving the separation of molecular species, the splitting ratio in which the fluid medium of the feed solution is divided between the two effluents is 1:1. The separation efficiency was determined to be the difference between the concentration of the dispersed matter in the charge stream and the concentration of dispersed matter in the effluent stream containing the reduced concentration of dispersed matter, expressed as a percentage of the concentration of dispersed matter in the charge stream. By a material balance, the concentration of dispersed matter in the effluent stream containing the increased concentration of dispersed matter can readily be computed. Air was used as the fluid medium in each of the experimental runs of Tables I and II. The operating temperature in all runs was room temperature. For all of the runs reported in Table I, the operating pressure was 1 atmosphere. For the runs involving separation of $Cl_2$, shown in Table II, an operating pressure of 10 p.s.i.a. was used. All other runs reported in Table II were conducted at an operating pressure of 1 atmosphere. In all cases, the current flow through the apparatus was less than 2 milliamperes.

TABLE I

SEPARATION OF PARTICULATE MATTER

| Dispersed Particulate Matter | Apparatus (Ref. Fig.) | Voltage (K.V.) | Concentration of Dispersed Matter In (gm/m³) | Concentration of Dispersed Matter Out (gm/m³) | Separation Efficiency (%) |
|---|---|---|---|---|---|
| Aluminum | 2 | − 8 | 0.3730 | 0.0008 | 99.79 |
| Reduction | 2 | −12 | 0.3730 | 0.0008 | 99.79 |
| Pot | 2 | −16 | 0.3730 | 0.0005 | 99.82 |
| Emission | 2 | −20 | 0.3730 | 0.0001 | 99.98 |
| | 2 | −30 | 0.3730 | 0.0000 | 100. |
| Aluminum | 1 | −40 | 0.4560 | 0.0025 | 99.45 |
| Oxide | 1 | −25 | 0.4560 | 0.0041 | 99.08 |
| | 1 | −50 | 0.4560 | 0.0009 | 99.98 |
| | 1 | −55 | 0.4560 | 0.0000 | 100. |
| Carbon | 1 | −40 | 0.4560 | 0.0005 | 99.99 |
| Black | 1 | −55 | 0.4560 | 0.0000 | 100. |
| | 1 | +40 | 0.4560 | 0.0028 | 99.94 |
| | 1 | +55 | 0.4560 | 0.0020 | 99.96 |
| Portland | 1 | −50 | 0.4560 | 0.0005 | 99.99 |
| Cement | 1 | −55 | 0.4560 | 0.0005 | 99.99 |
| Powder | | | | | |
| Fly Ash | 1 | −45 | 0.4560 | 0.0015 | 99.70 |
| | 1 | −55 | 0.4560 | 0.0006 | 99.99 |
| Graphite | 1 | −20 | 0.4560 | 0.0015 | 99.70 |
| Powder | 1 | +35 | 0.4560 | 0.0016 | 99.70 |
| | 2 | − 7.5 | 0.3730 | 0.0010 | 99.74 |

TABLE I-continued

SEPARATION OF PARTICULATE MATTER

| Dispersed Particulate Matter | Apparatus (Ref. Fig.) | Voltage (K.V.) | Concentration of Dispersed Matter In (gm/m³) | Concentration of Dispersed Matter Out (gm/m³) | Separation Efficiency (%) |
|---|---|---|---|---|---|
| | 2 | −10 | 0.3730 | 0.0015 | 99.61 |
| | 2 | − 5 | 0.3730 | 0.0016 | 99.57 |
| | 2 | −20 | 0.3730 | 0.0011 | 99.72 |
| | 2 | −40 | 0.3730 | 0.0000 | 100. |
| | 2 | −45 | 0.3730 | 0.0000 | 100. |
| | 2 | −55 | 0.3730 | 0.0000 | 100. |
| Iron Oxide | 1 | −30 | 0.4560 | 0.0015 | 99.67 |
| Powder | 1 | −45 | 0.4560 | 0.0002 | 99.95 |
| | 2 | −20 | 0.3730 | 0.0014 | 99.63 |
| | 2 | −30 | 0.3730 | 0.0010 | 99.73 |
| | 2 | −40 | 0.3730 | 0.0010 | 99.73 |
| Zinc Oxide | 1 | −25 | 0.4560 | 0.0025 | 99.44 |
| Powder | 1 | −40 | 0.4560 | 0.0010 | 99.78 |
| | 1 | −45 | 0.4560 | 0.0007 | 99.85 |
| | 1 | −50 | 0.4560 | 0.0005 | 99.89 |
| | 1 | −55 | 0.4560 | 0.0005 | 99.89 |

TABLE II

SEPARATION OF MOLECULAR SPECIES

| Molecular Species | Apparatus (Ref.Fig.) | Voltage (K.V.) | Concentration of Molecular Species In (p.p.m.) | Concentration of Molecular Species Out (p.p.m.) | Separation Efficiency (%) |
|---|---|---|---|---|---|
| CO | 1 | +40 | 250 | 132 | 47.50 |
| | 1 | +55 | 250 | 95 | 62.01 |
| $CCl_4$ | 1 | −25 | 500 | 220 | 56.25 |
| | 1 | −40 | 500 | 142 | 71.50 |
| | 1 | −55 | 500 | 140 | 72.05 |
| $SO_2$ | 1 | −15 | 500 | 330 | 33.65 |
| | 1 | −30 | 500 | 244 | 51.20 |
| | 1 | −45 | 500 | 159 | 68.17 |
| | 1 | −55 | 500 | 54 | 89.14 |
| NO | 1 | +30 | 250 | 202 | 17.55 |
| | 1 | +55 | 250 | 164 | 34.07 |
| $Cl_2$ | 1 | −20 | 500 | 292 | 41.43 |
| | 1 | −40 | 500 | 125 | 75.06 |
| | 1 | −55 | 500 | 11 35 | 93.5 |

In addition to those molecular species listed in Table II, many other molecular species, including inorganic compounds such as HF, $H_2S$, $NO_2$, $NO_3$, $SF_6$, and the like, organic compounds including various hydrocarbons, alcohols and the like, and various radicals dissociated from these molecules, have been separated successfully.

Other experimental runs have been made using apparatus (including a separating electrode) of varying design but within the scope of this invention, and with variations in the operating conditions including electrical loads. In all such cases, substantially similar beneficial results were obtained.

It is apparent from the above illustrations and discussion that charged or chargeable particulate matter and ionized or ionizable molecular species can be readily separated from a fluid medium in which they are contained, by passing said fluid medium through a filter-like separating electrode generating corona discharge in accordance with the practice of this invention. The material of construction and the design of said separating electrode, the over-all design of the apparatus, the applied electrical load and voltage wave form may be varied according to the material to be separated and the operational conditions. The apparatus provided by this invention can also be used as a contacter, to effect contact between a fluid and a particulate matter, and the fluid and particulate matter can subsequently be separated.

It is obvious, also, that mechanical means such as vibrators, scrapers, sonic devices, or the like, may be placed in the apparatus to facilitate the removal of the rejected material. As in the conventional electrostatic precipitator, a conditioning agent such as water vapor can be used to improve the charging and collecting characteristics of the particulate matter to be separated. A liquid such as water also can be used to scrub the particulate matter in the apparatus as is done in the conventional wet electrostatic precipitator.

When the apparatus is used as a contacter for mass transfer operations, such as for absorption or adsorption, the liquid or solid should be introduced into the apparatus in the particulate form, as may be obvious. As a chemical reactor, any solid or liquid reactants must also be introduced in the particulate form for better contacting and easy separation within the same apparatus.

It is apparent that the recycling of the fluid stream being treated can also be practiced in the apparatus to increase the final separation efficiency. In the alternative, several units of the apparatus may be connected in parallel and/or series in order to increase the capacity and/or the separation efficiency.

It should be understood that the charging, and therefore the discharging, of said separating electrode provided by this invention can be effected in various ways and through the use of various mechanisms. For example, the separating electrode can be charged directly by connecting it to a power source, or charged inductively by placing it very close to a separate discharging electrode. The resultant corona discharge can be effected by any one or a combination of the following several well-known mechanisms: (1) cold emission; (2) hot emission; (3) ion bombardment at the electrode surface, and the like.

The charging of particulate matter, and the ionization of molecules, also can be carried out through various mechanisms, for example: (1) conductive induction charging; (2) contact electrification; (3) space charging; (4) electron attachment; (5) electron impact; (6) photo-ionization at electrode surface; (7) photo-ionization in space; (8) ionization accompanied by decomposition; and other forms of chemical changes.

It is important that excessive space charging, back corona and other abnormal charging phenomena be prevented in the apparatus through prompt removal of the charged and/or ionized rejected material from the apparatus. The "leak coefficient" of the separating electrode may be affected by any one or a combination of the operating variables discussed above, as may be obvious.

It should be understood that this invention applies to the separation of all charged (and chargeable) particulate matters, solid and/or liquid, and/or ions and ionizable molecules, radicals and atoms, from a fluid medium in which they are contained, by passing said fluid medium through an electrode which is made in the form of a filter and which is electrically charged in the same polarity as that of the charged particulate matter and/or ionized molecular species, and by use of the electrostatic repulsive force acting between said electrode and said charged particulate matter and/or said ionized molelcular species as the driving force for separation. Therefore, a densely formed corona discharge over the entire surface of said filter-like separating electrode, and the resultant strong electrostatic repulsive force between said electrode and said charged particulate matter or ionized molecular species to be separated, are the keys to the separation method provided by this invention.

The invention claimed is:

1. Method for separating dispersed matter consisting essentially of electrostatically-charged finely-divided particles from a fluid medium containing same, said method comprising:

A. Continuously introducing said fluid medium containing the dispersed matter into a non-collecting separation chamber in the zone adjacent a first side of a separating electrode which divides said chamber into two zones and which is pervious to the passage of said fluid and dispersed matter;

B. Continuously subjecting said introduced fluid medium containing dispersed matter to the field of a dense and uniformly-distributed corona discharge occurring from said separating electrode, said separating electrode containing an electrostatic charge of the same polarity as that of the charge on said finely-divided particles and of a magnitude sufficient substantially to repel said finely-divided particles, whereby said finely-divided particles are selectively repelled from said separating electrode;

C. Continuously passing through said separating electrode and withdrawing from the zone adjacent the reverse side of said separating electrode fluid medium containing a reduced concentration of said finely-divided particles; and D. Continuously withdrawing from the zone adjacent said first side of said separating electrode a fluid medium containing an increased concentration of said finely-divided particles.

2. Method according to claim 1, wherein said dispersed matter to be separated from said fluid medium is charged prior to being subjected to the field of said corona discharge.

3. Method according to claim 1, wherein said dispersed matter is charged by being subjected to the field of said corona discharge.

4. Method according to claim 1, wherein said corona discharge is generated by a series of very short high voltage pulses applied to said separating electrode.

5. Method for separating dispersed matter consisting essentially of ionized molecular species from a fluid medium containing same, said method comprising:

A. Continuously introducing said fluid medium containing the dispersed matter into a non-collecting separation chamber in the zone adjacent a first side of a separating electrode which divides said chamber into two zones and which is pervious to the passage of said fluid and dispersed matter;

B. Continuously subjecting said introduced fluid medium containing dispersed matter to the field of a dense and uniformly-distributed corona discharge occurring from said separating electrode, said separating electrode containing an electrostatic charge of the same polarity as that of the charge on said molecular species and of a magnitude sufficient substantially to repel said molecular species, whereby said molecular species are selectively repelled from said separating electrode;

C. Continuously passing through said separating electrode and withdrawing from the zone adjacent the reverse side of said separating electrode fluid medium containing a reduced concentration of said molecular species; and D. Continuously withdrawing from the zone adjacent said first of said separating electrode a fluid medium containing an increased concentration of said molecular species.

6. Method according to claim 5, wherein said dispersed matter to be separated from said fluid medium is charged prior to being subjected to the field of said corona discharge.

7. Method according to claim 5, wherein said dispersed matter is charged by being subjected to the field of said corona discharge.

8. Method according to claim 5, wherein said corona discharge is generated by a series of very short high voltage pulses applied to said separating electrode.

* * * * *